United States Patent [19]

Giros

[11] 4,026,450

[45] May 31, 1977

[54] APPARATUS FOR TREATMENT OF ELONGATED FLEXIBLE MATERIAL

[76] Inventor: Marcel A. P. Giros, Route de Saint-Dizier, Ancerville, France, 55170

[22] Filed: Mar. 12, 1976

[21] Appl. No.: 666,198

Related U.S. Application Data

[63] Continuation-in-part of Ser. No. 361,616, May 18, 1973, Pat. No. 3,951,322.

[30] Foreign Application Priority Data

May 24, 1972 France ..... 72.19235

[52] U.S. Cl. ..... 226/42; 226/117; 226/119

[51] Int. Cl.[2] ..... B65H 23/22

[58] Field of Search ..... 226/42, 43, 108, 117, 226/118, 188, 119

[56] References Cited

UNITED STATES PATENTS

| | | | |
|---|---|---|---|
| 2,048,182 | 7/1936 | Ybarrondo | 226/42 X |
| 3,049,308 | 8/1962 | Lang | 226/43 X |

*Primary Examiner*—Richard A. Schacher
*Attorney, Agent, or Firm*—Otto John Munz

[57] ABSTRACT

An apparatus for conveying elongated flexible material such as metal strips, wire and tubes by means of rotating shafts in a processing container holding a treatment-fluid for treatment of the material chemically, electrolytically, by pickling, deposition and similar processes, provides for the means of: coiling the material, imparting the coiled material the shape of a helix having a plurality of loops; causing at least a partial immersion of the loops of the helix in the treatment-fluid; advancing the helix in the said container at an advance speed; controlling the entry speeds of the helix relative to a predetermined speed withdrawal of the helix from the container.

In a preferred and more efficient mode of treatment, the inlet speed of the helix exceeds the exit speed with a consequent slow and progressive increase of the length of the helix immersed in the treatment-fluid at a time in a first phase of the operation.

In an additional improvement of the apparatus means are provided to temporarily lower the inlet speed of the helix. Optimum speed limits are identified. Improved means are provided to subject the progress of the loops within the container from a decrease in advance down to momentary stops to control also the size of the loops. The helix is imparted forward and backward directed wave patterns of controllable amplitudes, durations and frequencies with superimposed oscillations in three orthogonal directions, resulting in optimum desirable treatment-fluid exposures of the loops.

18 Claims, 15 Drawing Figures

3
70
5
6
1
73
74
72
ΔL

S2
S1

Sn

S3

Sp

S4

9' t

AN APPARATUS FOR TREATMENT OF ELONGATED FLEXIBLE MATERIAL COMPRISING MEANS FOR:

Fig. 7

A. COILING THE ELONGATED MATERIAL INTO LOOPS

B. IMPARTING TO THE MATERIAL THE SHAPE OF A HELIX

C. INTRODUCING THE HELIX INTO THE CONTAINER AT AN INITIAL INLET SPEED UNDER A POSITIVE IMPELLING FORCE

D. CAUSING AT LEAST A PARTIAL IMMERSION OF THE LOOPS OF THE HELIX IN TREATMENT FLUIDS IN THE CONTAINER

E. ADVANCING THE HELIX THROUGH THE CONTAINER AT A PREDETERMINED ADVANCE SPEED

F. CORRELATING THE INLET SPEED WITH THE ADVANCE SPEED AT A PREDETERMINED RATIO

G. CAUSING INTERMEDIATE MOMENTARY INTERRUPTIONS IN THE ADVANCEMENT OF LOOPS RESULTING IN CONTROLLABLE FORWARD AND BACKWARD WAVE PATTERNS OF THE ADVANCING HELIX OF PREDETERMINED DURATIONS AND AMPLITUDES, FREQUENCIES AND DIRECTIONS OF THE LOOPS

H. CORRELATING THE ADVANCE SPEED WITH THE EXIT SPEED AT A PREDETERMINED RATIO

I. EXTRACTING THE LOOPS OF THE HELIX FROM THE CONTAINER AT A PREDETERMINED EXIT SPEED

J. REMOVING AND CORRELATING THE REMOVAL OF ADHERING FLUID FROM THE LOOPS EMERGING FROM THE CONTAINER WITH THE EXIT SPEED OF THE LOOPS

K. RINSING AND CORRELATING THE RINSING WITH THE EXIT SPEED OF THE LOOPS

L. PROVIDING METERING MEANS FOR THE TREATED MATERIAL AND TREATMENT-FLUID LEVEL MONITORING MEANS

M. PROVIDING MEANS FOR REPLENISHING USED-UP TREATMENT-FLUID IN CORRELATION WITH THE RESULTS ESTABLISHED BY MEANS L.

APPARATUS FOR TREATMENT OF ELONGATED FLEXIBLE MATERIAL

CROSS REFERENCE TO RELATED APPLICATIONS

This is a continuation-in-part application of a copending parent U.S. patent application Ser. No. 361,616 filed on May 18, 1973 now U.S. Pat. No. 3,951,322 by the same inventor for: METHOD AND APPARATUS FOR TREATMENT OF FLEXIBLE MATERIAL, and the filing date thereof, and the priority of French application Ser. No. 72 19235 of May 24, 1972 are claimed for all subject matter common therewith.

This application also is related to a simultaneously filed application of the same inventor Ser. No. 666,199 for: METHOD FOR CONTINUOUS TREATMENT OF ELONGATED FLEXIBLE MATERIALS.

BACKGROUND OF THE INVENTION

1. Field of the Invention

Apparatus for conveying a coiled strand by means of rotating shafts at different speeds. (Class 226/188).

2. Description of the Prior Art

The prior art apparatuses for conveying flexible material, such as a metallic band, tube, wire or helix suffer the disadvantages that they cause changes in the frictional relationships of the material with the treating apparatus as the material advances at a given speed through a treatment container from ingress to outgress. These changes result in assymetrical developments of loops in their spacings, and sizes and in their disfigurations, bends and three-dimensional deformations, as well as in variable treatment times for individual loops, all this resulting in non-uniform and undesirable outputs.

SUMMARY OF THE INVENTION

The primary objects of the invention are to provide an apparatus for conveying and surface treatments such as pickling, of elongated flexible materials, such as metallic bands, tubes, wires and strip metal traveling through a container holding a treatment-fluid, which:

avoids the disadvantages of apparatuses of the prior art;

results in a uniform synchronized processing even of very lengthly materials having lengths up to several miles;

decreases wear and tear on the treating apparatus, and permits an uninterrupted well organized continuous progress of the material through the container.

Another object of the invention is to provide means to control the ingress and advance speed of the material into and through the container in a first stage of the operation relative to the progress and exit speeds of the treated material.

Yet another object of the invention is to provide means to regulate the respective ingress, progress and egress speeds of the material relative to each other in such a manner that in the first stage of the operation the length of the material under treatment is increased while in a second phase of the operation, the length of the material under treatment is decreased, the optimum limits of which also have been established.

Other objects of the invention and the many of its advantages will become obvious to those skilled in the art from the following description taken in conjunction with the appended drawings and claims.

FIGS. *5a*, *5b*, *5b'*,*5c*, *5c'*, *5d*, *5d'*, and *5d''* are schematic diagrams of a cycle for the regulation of the loops of the coil.

Figures 5, 5A, 5B, 5C, 5D, 6:
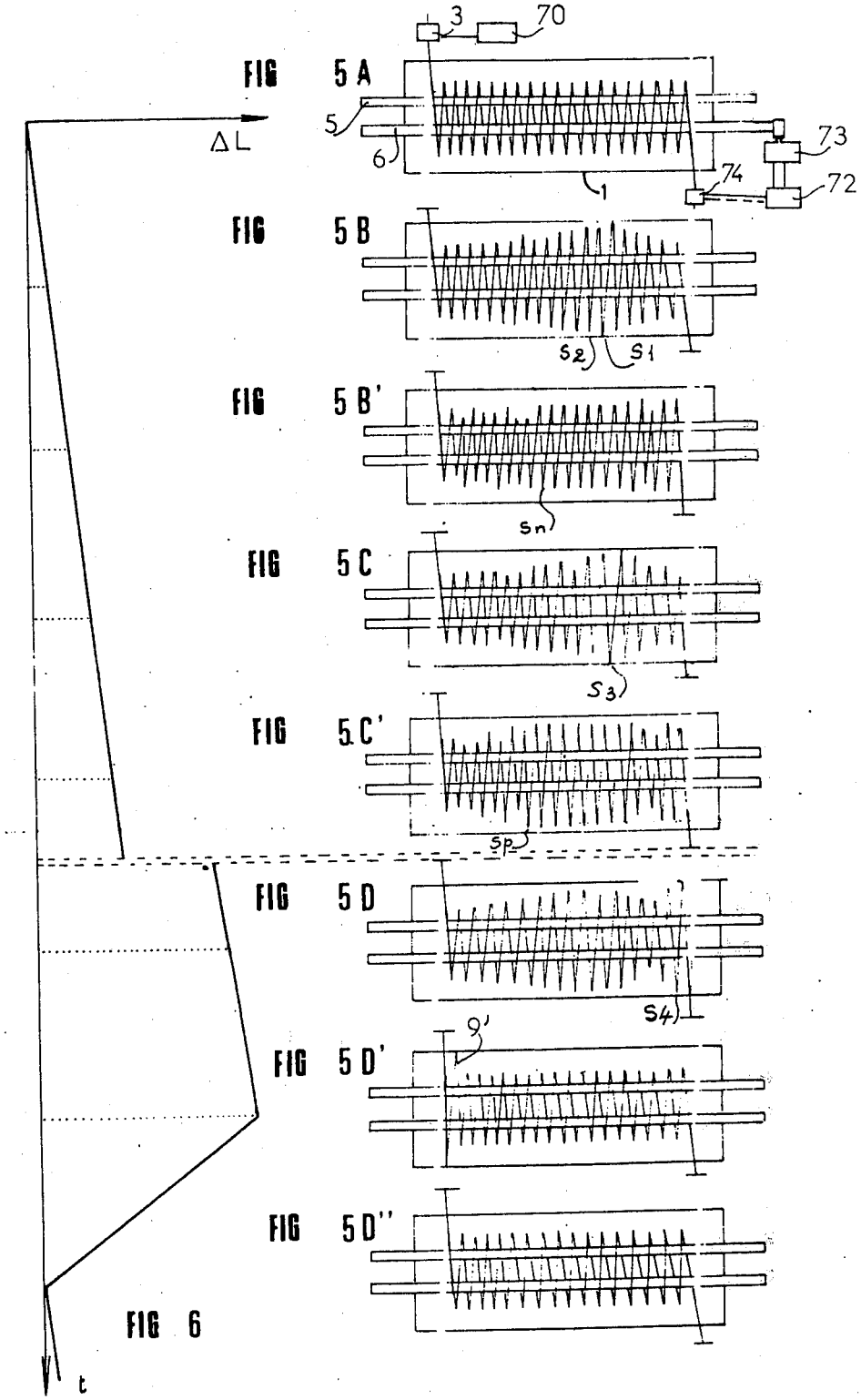

FIG. 6 represents graphical coordinations of the variation in the period of time and length of the material in the processing container shown on FIGS. *5a* to *5d''*.

FIG. 7 is a schematic diagram showing the sequential arrangements of the several means employed in accordance with the invention, some of these means being optional.

FIG. *7a* is a schematic block diagram showing the correlations and controls of the several means of the invention.

Double descriptions of parts equivalent to the several above figures and to those of the present case Ser. No. 361,616 were omitted for purposes of brevity.

DESCRIPTION OF THE PREFERRED EMBODIMENTS

Figure 1:
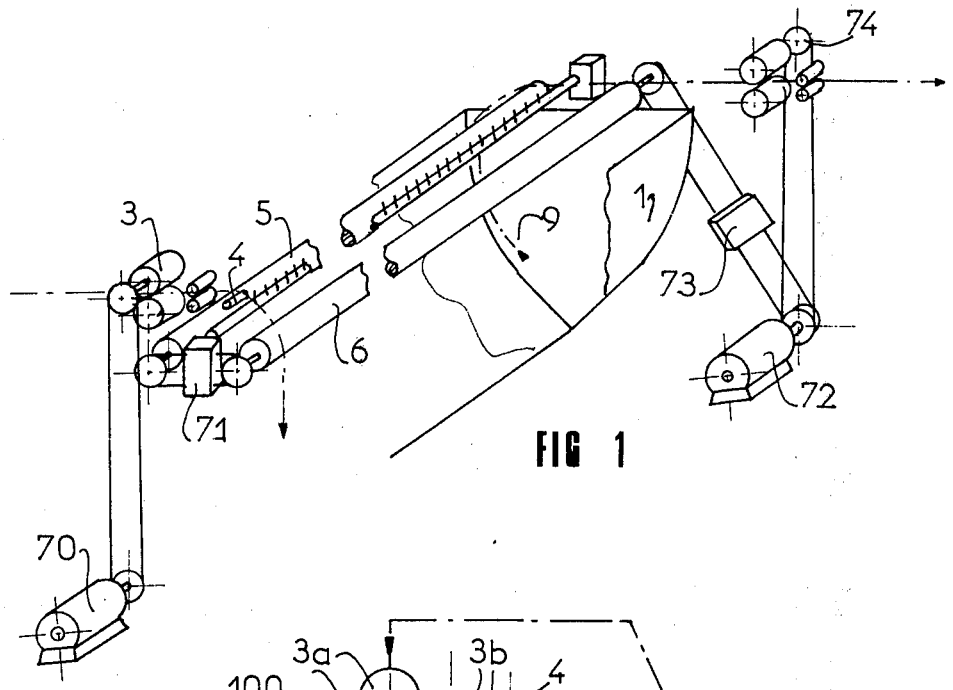
FIG. 1 is a schematic diagram, in perspective, of the processing container and motor means in accordance with the invention, for the treatment of material in strip form.

The present invention is applicable to the apparatus shown in the parent case as well as to improvements depicted on FIGS. 1 to *7a* of the present case. The apparatuses are shown by way of examples only and the invention is not limited to them.

The apparatus of the parent case is disclosed as having a container for the treating fluid, first and second strip supporting elongated shafts journaled for rotation over the container in spaced side-by-side relation on two parallel axes, with a comb fixed between the shafts and in parallel with them in a plane substantially defined by their uppermost parts and co-extensive therewith. The comb comprises spaced upstanding teeth and rotating means engage and feed the material under a forwarding force at a predetermined speed first into the inlet side of the container at one end of the shafts, therefrom upwardly over and in transverse contact with the shafts in a plurality of loops, while each loop is quided between consecutive pairs of teeth of the comb, with each loop depending into the container for contact with the treating fluid. Means are provided to control the relation between the angular rates of the co-joint rotation of the shafts and to positively feed and subsequently to extract the material from the container at predetermined speeds to provide loops of different sizes and with varying behaviors during the ingress into progress through and egress out of the container. The loops together form a helix, which advances continuously through the container and dips into the treating fluid therein.

Means are provided to control the ratio of the linear speed of the helix inside the container (that is the progress speed) relative to its inlet and to its discharge speeds.

Additional means are disclosed in the parent case to momentarily stop the advancing material, to control the size of the loops.

The invention as depicted on FIGS. 1 to 7 of the present application discloses additional improvements over the parent case by providing two stages to control the speed ratios in the respective ingress, progress and egress speeds of the processed material relative to each other:

in a normal operating stage which synchronizes the progress speed with the egress speed, during which the length of the material in the container increases and in an adjustment or normalizing stage during which the length of the material in the container decreases.

This is accomplished by providing intermittent "transient" contacts between the material and the walls of the processing container, to ensure a more satisfactory regulation of the production and behavior of the loops, resulting from the alternation of a normal rate of speed operation, accompanied by a slow increase in the length of the material being treated, with an adjustment period of shorter duration serving for the periodical reabsorption of the excess length accumulated during the period of normal operation.

Under a normal rate of operation the peripheral speed of the carrier shafts is slightly above that of the material on entering the apparatus, this latter speed itself being slightly above that of the material emerging from the apparatus.

The additional improvement disclosed in the present application provides for means and operational details aimed at the use of the transient contacts between the material to be treated and the walls of the processing container in an improved manner, in order to affect completely automatic regulation of the apparatus including the starting and stopping operations.

This regulation is effected by the alternation of normal running conditions with adjustment or normalizing conditions. During normal running conditions there is a succession of means to provide three decreasing linear speeds in the following order: the peripheral speed of the carrier shafts, the instantaneous speed of the material at the inlet and the speed of the material at the outlet; while these conditions of operation prevail, the total length of the material in the container slowly increases. While adjustment conditions prevail, their duration being shorter than the foregoing, the speed at the inlet becomes less than that at the outlet, to provide the readjustment required for the length of the material processed.

The apparatus causes the material to enter the container at a speed which is:

either slightly above the extraction speed under normal running conditions;

or clearly below the extraction speed, (down to zero) during the adjustment phase.

Means are provided to create a switch-over speed to control the independent motor means in accordance with the size of the first loop of the helix.

When the size of the first loop becomes larger and exceeds the limits of a certain reference size adjustment means are provided to change the running of the apparatus from normal conditions to adjustment conditions.

When the size of the loop decreases below this same reference size normalizing means are provided to change the operation of the apparatus from the adjustment conditions to the normal operating phase.

While the instantaneous values of the ingress speed, the progress speed and the egress speed are never the same, neither in the normal running conditions nor in the normalizing conditions, it should be clearly understood that during a long period of operation, such as a full day, the mean ingress speed, the mean progress speed and the mean egress speed are equalized. These equalizations are obtained, according to the invention, through the phase alternation as described.

In order to carry out the regulating action in accordance with the invention and to improve on the efficiency of the apparatus a transient stop is provided by contacts with the lateral wall of the container, in front of which the material passes from the top downwards on a "downstream" wall, while such a contact with the base of the tank is avoided.

In accordance with an improvement of the shape of the container, which in the parent case was shown having a circular cylinder base, the shape of the container is imparted a cross-section similar to that of a reversed pointed arch. Because of that any contact between the material and the trough thus formed in the base of the tank becomes impossible.

The angle of the pointed arch is narrower in proportion to the increase in the radial deformation capacity of the loops in accordance with the flexibility of their material.

The walls are lined with anti-corrosive bricks, if the treatment fluid is acid. On the wall where the transient contacts take place the lining is supplemented by a material such as slabs of volcanic lava. An improvement thereover is the provision of polished electroceramic tiles, the inventor having discovered that their adhesion to the material being processed is firmer than that of the lining of the shafts, itself generally consisting of polyvinyl chloride resin, as otherwise the transient contact would merely cause protracted friction, without bringing the loop to a stop.

Under these conditions, an automatic regulating cycle of the apparatus is obtained, as follows:

at the begining of the normal operating phase of each cycle, the loops have the same size since they have been regulated at the end of the normalizing phase of the preceding cycle. The length of the looped material between the inlet and the outlet is at a minimum, but sufficient to ensure that the container will be filled in the normal manner. The driving speed of the shafts exceeds the inlet speed, so that the speed of the shafts goes beyond that required for the compensation of the inevitable slip normally taking place in the material being driven. Consequently, the loops on the outlet side tend to increase, at the expense of those on the inlet side. This increase in size, however, is uncertain, the coil becoming irregular. A larger loop than the next loop adjacent to it will make contact with the downstream wall. This results in a transient contact which sets up a reverse wave, progressing towards the inlet which regulates the loops through which it passes but which is generally only limited in time and does not reach the inlet. As a number of these limited temporary "retrograde" waves may occur simultaneously, the helix presents an appearance of permanent agitation resulting from being subjected to two conflicting forces:

the thrust of the material towards the outlet, the speed of the shafts being above the inlet speed, and the retrograde regulating waves triggered by each transient contact.

During this time, the length of the material in the container increases slowly but evenly, the inlet speed being slightly above the outlet speed. At the beginning of the normal operating phase the increase in the size of the loops is counteracted by the retrograde waves, which transfer the increase in size so that it takes place towards the inlet and it does not reach the outlet. This occurs at the end of a certain time, such as about 10 minutes. A complete reverse wave then takes place, which passes through the entire container, reaching the inlet loop, which suddenly increases in size. This results, via suitable pick-up means, such as a sensor 12 visible on FIGS. 2 and 4 in the change-over from normal operations to the adjustment phase. The independent inlet motor means come to a stop or definitely slow down, whereas the outlet motor means of extraction and shafts remain unaffected.

Consequently, the inlet loop, the tail of which is stopped or considerably decelerated, rapidly resumes its original size, resulting in a return to the initial condition of normal operation, which thus recommences.

While during the operation there is always a continuous longitudinal helix present within the container, it is formed of continuously entering, and egressing different new loops curved at about right angles to their advancing direction. The helix as such is continuously subjected to the three-dimensional forces of the apparatus, which alternately propagates it and stops it, causing it to contract and expand and simultaneously to shrink, to swell and to oscillate continuously with undulating ridges assymetrically but harmoniously running back and forth, the stops concentrating the propagating energy intermittently at the points selected by the present improvements, providing together with the changing speeds disturbances in the sizes and speeds of the loops.

FIG. 1 shows a number of elements of the apparatus for the conveying of coiled strip, similar to those disclosed in the parent case. An insertion device 3 for the material and motors 70 for serving to drive it, bending roller 4, rotary carrier shafts 5 and 6 connected by a coupling device 73 to a motor 72 which also drives extraction devices 74 for the materials are provided. An additional improvement is that the processing container is a tank 1 having the cross section of a reversed pointed arch with an angle at the apex which is approximately equal to a right angle. The lateral walls or flanks of the tank are substantially circular cyclinders. The capstan 21 and the motor 70 of FIG. 1 of the parent application are eliminated.

In FIG. 1 of the present case the inlet motor 70 drives the elements feeding the strip and the outlet motor 72 drives the shafts and means of extraction. Operation and stop of motor 70 are controlled by a sensing element 12 shown on FIG. 2; motor 72 drives the elements of extraction at a speed slightly lower than that at which motor 70 drives the elements of introduction of the strip.

Figure 2:
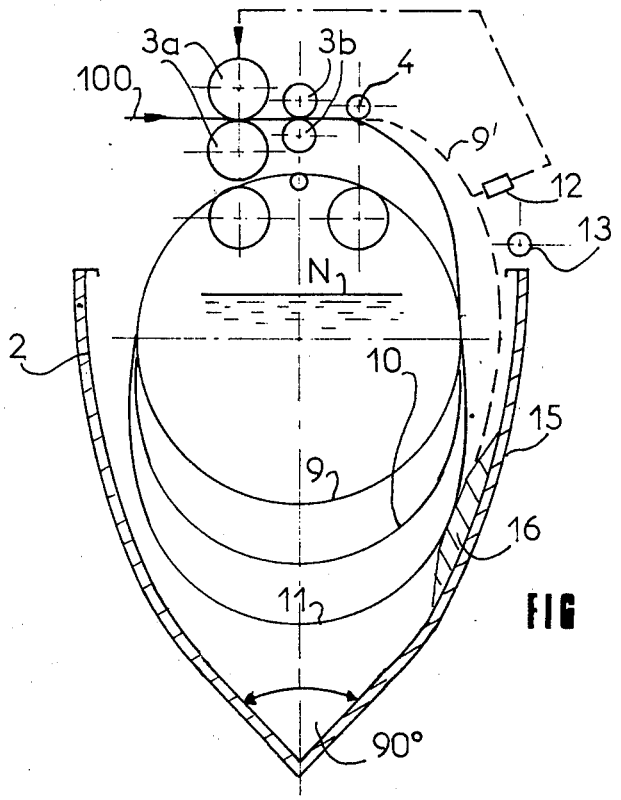
FIG. 2 is a schematic sectional diagram of a processing container, with associated motor means for causing strip material to enter it and to move through the container.

As may be seen from FIG. 2, this tank is lined internally with anti-corrosive bricks 2 which are indispensable when the treatment bath is acid; the level of the bath is shown at N.

PVC, polyvinyl chloride, forms the coating of the rotating shafts because of its low coefficient of friction. The loops are advanced by the shafts by sliding and slipping over them. The covering of the side walls of the container must have a very high friction coefficient in order to ascertain a temporary stop of the loops which come in contact with it. The coating used in the parent application was lava. Lava presents the problem of being a natural rock the physical properties of which as well as its friction coefficient are not constant. Lava therefore is not a viable material.

Furthermore, lava wears out rather fast, resulting in two different difficulties which can be overcome with electroceramic tiles. First, due to its wearing out, lava produces powder which mixes with the treatment-fluid resulting in thick mud threatening to clog the inlet and outlet ducts of said fluid. Second lava slabs cannot be incorporated in the anti-corrosive brick lining of the walls because their frequent replacement due to wearing out would imply a complete rearrangement of the whole covering.

Ceramic tile on the other hand is an industrial product which gives us a choice of certain physical properties, especially the friction coefficient, which properties can be maintained at a constant level. This then would be a viable material. Ceramic tiles being almost everlasting, do not present a powder problem and are preferably incorporated in the rest of the covering.

Therefore, one of the lateral walls or flanks 15 of the tank on the same side as the bending roller 4, is partially lined, approximately half-way up the wall, with slabs 16 of such ceramic tiles or equivalent material integrally with the anti-corrosive bricks.

The motor means shown in FIG. 2, are those for the introduction of the material 100 which in this case is strip metal. Roller trains *3a* and *3b* drive the band practically without slip, followed by a bending roller 4 serving to give it a suitable curvature. These rollers have a cylindrical surface, and the strip is not cambered transversally. It therefore retains its intrinsic elasticity. The strip then passes over the "upstream" and "downstream" rotary carrier shafts 5 and 6, forming the first loop 9, of which the normal shape is almost circular, since the peripheral speed of the shafts is greater than the insertion speed produced by *3a* and *3b*. A permanent slip of the band thus takes place on the shafts. The other loops, such as 10, are normally larger than the first, with more or less elongated shapes, and descend more or less towards the base of the tank.

As the driving speed of the shafts exceeds the insertion speed of the material, the loops tend to increase in size on the outlet side of the tank, so that one loop 11 makes contact with the lining 16, which has a friction coefficient greater than that of the lining of the shafts. It has been found by experience that each loop is attracted towards the immersed part of the downstream flank in the tank, in front of which the material to be treated moves past from the top downwards. The result is that with tanks, having a vertical sectional plane of symmetry identical with the vertical plane of symmetry of the pair of rotary shafts, the transient contacts begin to form on this part of the downstream flank of the tank. Now this circumstance makes it easier to keep the loop in the vertical position, because a contact of this kind, which is lateral, tends to cause the loop to rise only above the upstream rotary shaft but by no means above the downstream rotary shaft. On the contrary, if the transient contact were effected at the lowest point of the base of the tank, at a distance equal from the two rotary shafts, the turn would tend to rise simultaneously above these two shafts and come to rest on the side, at the risk of penetrating the plane of an adjacent turn.

The contact of loops 11 and 16 only lasts a moment, and this loop then moves away again, driven by the loop immediately downstream from it. In its departure it has resumed a normal size. The surplus length which it has lost, because one of its ends slipped on the shaft, is carried over to the loop immediately upstream from it, which likewise comes to a stop or continues to move, according to whether this surplus causes or does not cause it to touch the lining 16 and so forth. This is the basic regulating phenomenon, and the conjunction of these phenomena produces a regulating cycle, which will now be described by reference to FIGS. 5*a* to 5*d*.

These figures show a schematic plan view of the tank 1, the insertion motor means 3 with their independent motor 70, the rotary carrier shafts 5 and 6 driven by the motor 72, and the extraction motor means 74 driven by the same motor 72 as the shafts. FIGS. 5*a* and 5*d* depict the same commencement and termination of the complete regulating cycle.

In FIG. 5*a* all the loops are substantially of the same size. In 5*b* the effect of the surplus speed of the shafts manifests itself in a non-uniform size for the loops, and one loop $S_1$ contacts the flank of the tank 1; the transient contact in question is transmitted to $S_2$, then still farther upstream, resulting in a retrograde wave which reaches $S_n$ without rising any higher. At this moment (FIG. 5*b'*) all the loops between $S_1$ and $S_n$ have been regulated. The retrograde wave is merely temporary, because the excess length of $S_1$ in 5*b* has been shared between $S_1$ and $S_n$. Only a very short time elapses between 5*b* and 5*b'* (a few seconds).

At a later period (FIG. 5*c*) another loop $S_3$, by transient contact with the tank, sets up a further temporary retrograde wave between points from $S_3$ to $S_p$ (FIG. 5*c'*). A number of retrograde waves may occur at the same time, and the effect of these waves, proceeding upstream, in conjunction with the general progression downstream, resulting from the excess speed of the shafts, produces a perpetual vibration in the coil, contrasting with the deceptive regularity of the helical configuration of material of the prior art systems, in which rigidity of the turns results from the camber of the strip.

If means would be provided for keeping this length constant such as by strictly equalizing the inlet and outlet speeds, this length could be kept constant throughout an entire working operation, such as a day. In practice this is not possible, because the driving means at the inlet and at the outlet are imperfect. The material being treated undergoes a more or less uncertain slip, which is also assymmetrical, because the surface of the strip at the outlet is different in nature from its surface at the inlet, owing to the very treatment which it has undergone.

An operator thereof has to keep a watch on the coil and use his judgement in controlling the entry speed, in order to ensure that on the average it would be equal to the outlet speed. This step is a considerable improvement over the prior art, as the operator no longer has to handle the treated material directly and he is able to keep watch simultaneously on a number of production lines side by side.

The invention provides for an apparatus for regulating the length of the coil, which is entirely automatic, this result being obtained by the alternation of normal running conditions with an adjustment stage.

During normal operation the entry speed by rollers 3, exceeds the outlet speed by rollers 74. The length of the strip being treated increases, and this increase $\Delta$ L is shown along the ordinates on the graph of FIG. 6, in which the time is shown on the abscissae. The average size of the loops increases, and the adjacent loops at the outlet begin to increase likewise; at the moment shown on FIG. 5*d* a loop $S_4$ effects transient contact with the flank of the tank; this results in a complete retrograde wave which reaches the inlet and transfers to the first loop 9 the entire excess length $\Delta$ L. The loop 9 suddenly increases in size at 9' as shown on FIGS. 5*d'* and 2.

It acts on a contact 12 which stops the insertion means for the time required to enable the excess length $\Delta$ L to be reabsorbed (FIG. 5*d''*). This constitutes the adjustment phase. When the loop 9 has resumed its normal size the conditions shown in FIG. 5*a* prevail once again and a repetition occurs with a fresh cycle commencing under normal running conditions.

If for some reason the motor means for the extraction of the material slow down or even come to a stop, the shafts will stop likewise and the contact 12 will shut off the means for the insertion of the material.

The premise for the aforesaid improvement is that the extraction speed must never exceed the entry speed.

In accordance with FIG. 1, the motor directly drives the extraction means 74, driving the shafts 5 and 6 via a coupling device 73 which is a speed changer.

It is essential that the drive of the rotary shafts should be effected simultaneously with that of the extraction means. It is also essential to make the speed ratio between these two driving operations adjustable, because, while on extraction, there is every reason to ensure that the drive of the material being treated is of the positive kind, without slip, this is by no means the case with the drive of this material by the rotary shafts; the processed material on the rotary shafts is subject to a certain slip, because the adhesion of the said material to the said shafts is comparatively weak, this adhesion being produced solely by the weight of the loop resting on the shafts, and it is because the magnitude of this slip depends on a number of different factors, which change according to the sample of the material being treated, that it is necessary to adjust the aforementioned speed ratio. If the drive of the processed material by the rotary shafts were likewise positive, the problem of regulating the coil would obviously not arise.

The coefficient of friction of the treated material on the lining material of the base or flanks of the tank must be greater than that of this material on the PVC lining of the rotary shafts, as otherwise the contact of the said material on the base or flanks of the tank could not be temporary only and would manifest itself in a protracted friction on the lining material, since the adhesion to the rotary shafts would predominate. When a loop is simultaneously in contact with the rotary shafts, which do not cease rotating and with a certain stationary part of the base or flanks of the tank, the adhesion of the treated material to the lining material of the stationary part must be stronger than its adhesion to the lining of the rotary shafts. This is the reason why for this lining, polyvinyl chloride has been selected, because of its low coefficient of friction with most solids, so that the strips, wires or metal tubes adhere to it far less firmly than to the slabs of volcanic lava or electroceramic tiles.

Therefore and in view of the slip of the processed material on the rotary shafts, it will become obvious that in order to compensate this slip, the rotary shafts must be caused to rotate at a relatively higher speed: otherwise the output of the insertion or entry means would not be transmitted in its entirety to the output of the extraction means, and the helical material would tend to undergo a continuous radial shrinkage from the point of insertion to the point of extraction. On the contrary, if the rotary shafts have a peripheral speed exceeding the compensation of the slip, the coil will tend to undergo a gradual radial increase from the point of introduction to the point of extraction; this circumstance starting from the last loop before the extraction, is in every way favorable to the production of the phenomenon of transient contacts, which propagates itself, within a few seconds, from the last loop as far as the first loop following the introduction.

Thus forward and backward directed wave patterns of the progressing expanding and contracting helix with undulating ridges and continuous oscillations thereof are produced of predetermined controllable amplitudes, durations and frequencies. Optimum treatment-fluid exposures to the coils are provided, as the progressing, vibrating elastic helix churns up the treatment-fluid, whereby simultaneously the sizes of the loops and their intermittent transient stopovers are controlled.

Figure 3:
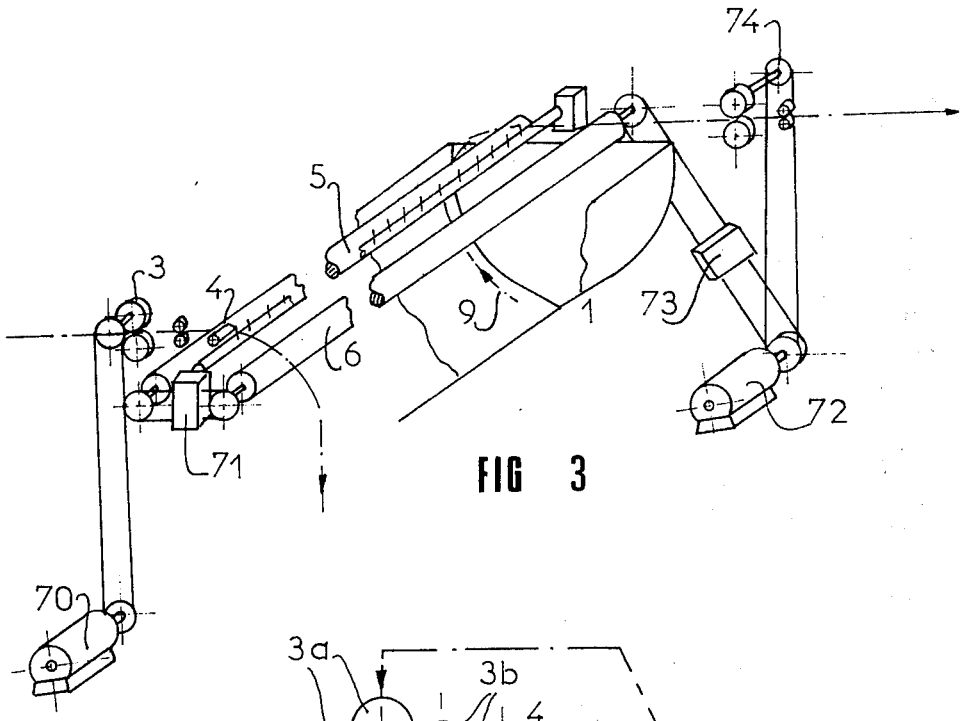
FIGS. 3 and 4 correspond to FIGS. 1 and 2 and depict the operation for the treatment of a wire.
Figure 4:
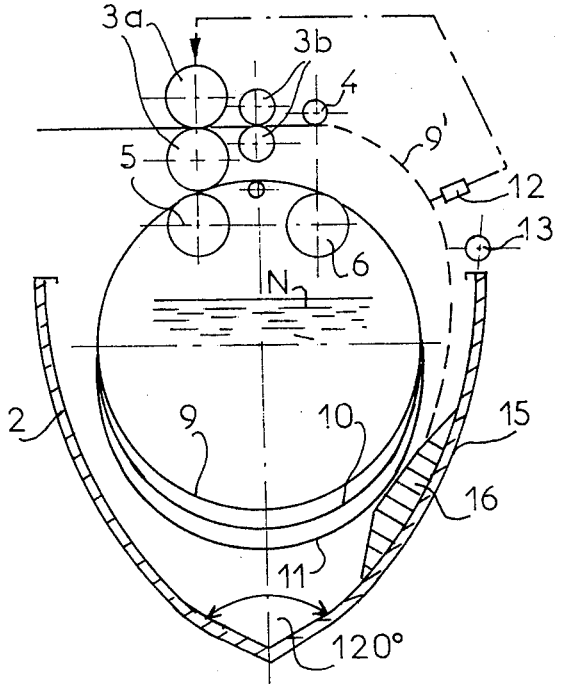

FIGS. 3 and 4 are analogous to FIGS. 1 and 2, except that the profile of the tank 1 is adapted to the treatment of wire instead of strip. Wire being more rigid than strip, the configuration of the turns is closer to the circular: this is why the optimum angle at the apex was found to be preferably about 120° instead of a right angle. The processing container is thus utilized more satisfactorily, and there is nevertheless no risk that the loops would touch the bottom of the tank. The means for the introduction and extraction of the wire are naturally adapted to the profile of the material; they comprise rollers with circular grooves. As regards the rest of the system, the apparatus and operation are the same as in the case of strip metal; a normal operating stage, characterized by three decreasing successive linear speeds: of the carrier shafts, of the means to introduce the material and to extract it, and a stage during which the length of the material in the container is adjusted, for which stage the speed of the material at the inlet is nullified or at all events greatly reduced by comparison with the outlet speed.

In any case, during the normal running phase, the insertion speed must be greater than the extraction speed of the material if the apparatus is to function satisfactorily. Experience has shown, however, that this speed ratio must be very close to one and that the inlet speed must not exceed the extraction speed by more than 1 percent. A preferred satisfactory speed ratio is about 604/600, in which case the insertion speed is about 0.7 percent above the extraction speed. On the other hand, the peripheral speed of the rotary shafts supporting the material must be about 1 to 2 percent greater than the extraction speed.

Finally, the foregoing numerical data show that for a normal operating phase of 5 to 10 minutes the adjustment phase, during which no material is entering the apparatus, amounts to about 2 to 4 seconds.

The apparatus means of the invention are diagrammatically represented on FIG. 7.

FIGS. 1 to 6 of the parent case Ser. No. 361,616 are to be included by reference.

Figure 7A:
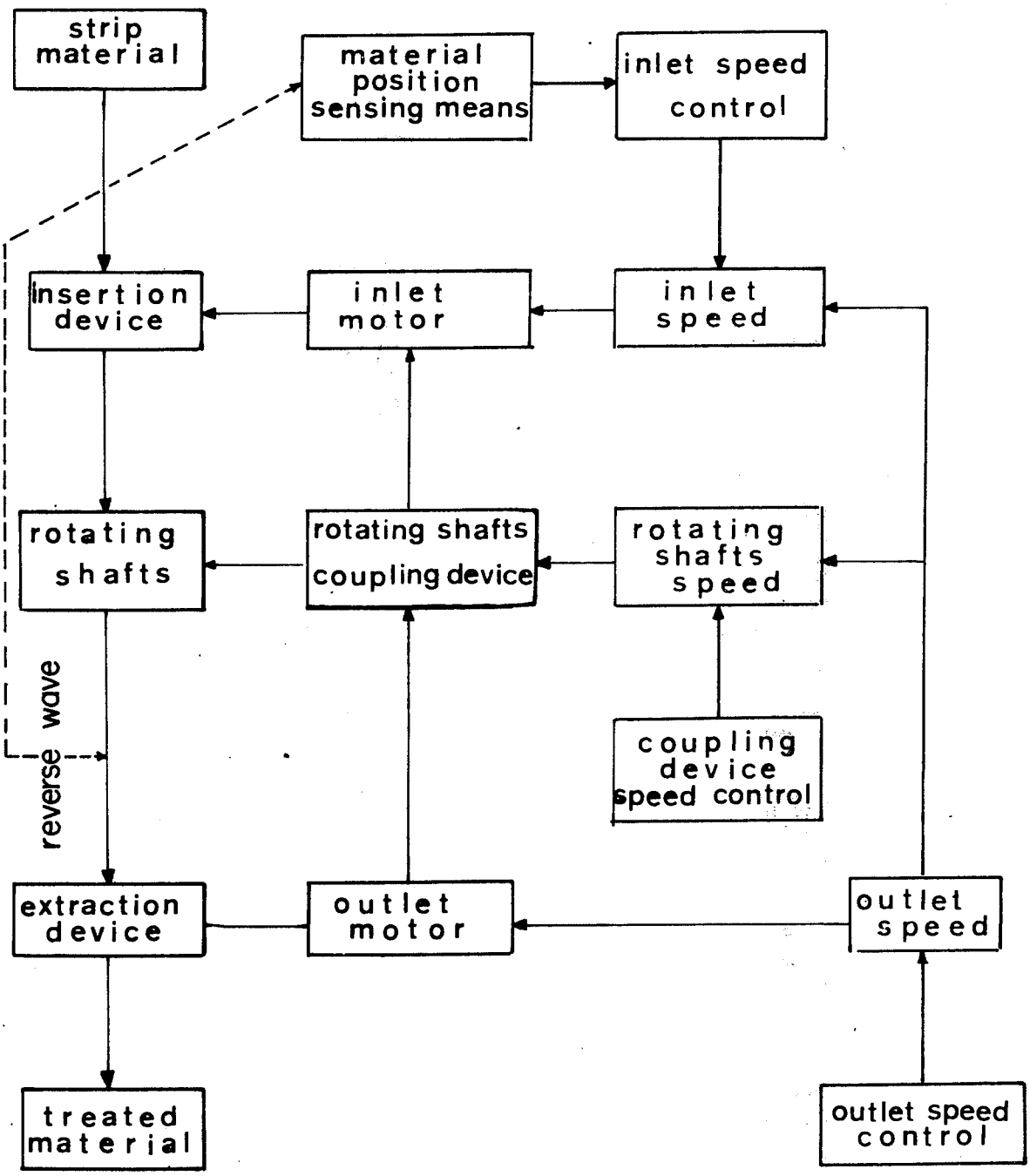

The correlations and controls of the several steps means and speeds according the invention are represented on FIG. 7*a*.

A predetermined outlet speed, controlled by an outlet speed control, results in a predetermined speed of the outlet motor. A coupling device speed control controls the speed of the device coupling the rotating shafts to the outlet motor, resulting in a predetermined rotating shafts speed and material advance speed. Material position sensing means monitor the material introduced through the insertion device and control the inlet speed through an inlet speed control, resulting in an inlet motor speed for the inlet motor, which it self commands the insertion device.

I claim:

1. An apparatus for treatment of elongated flexible material in an elongated container prefilled with a treatment fluid comprising means for:

B. imparting to the material the shape of a helix

C. introducing the helix into a container having a cross-sectional shape of an arch at an initial inlet speed under a positive impelling force D. causing at least a partial immersion of the loops of the helix in treatment fluids in the container E. advancing the helix through the container at a predetermined advance speed G. causing intermediate momentary intermittent interruptions in the advancement of loops resulting in controllable forward and backward wave patterns of the advancing helix of predetermined durations and amplitudes, frequencies and directions of the loops H. Correlating the advance speed with the exit speed at a predetermined ratio.

2. An apparatus as claimed in claim 1, further comprising means for:

A. coiling the elongated material into loops, said means A preceeding means B.

3. An apparatus as claimed in claim 1, further comprising

F. means for correlating the inlet speed with the advance speed of the material at a predetermined ratio, said means F preceeding means G.

4. An apparatus as claimed in claim 1, further comprising means for:

I. extracting the loops of the helix from the container at a predetemined exit speed.

5. An apparatus as claimed in claim 1, further comprising a first motor means operatively connected to said means B, C and D, imparting an inlet speed to the material;

a pair of parallel elongated shafts, spaced from each other in a plane longitudinally superimposed over the length of the container and journaled for cojoint rotation and a second motor means operatively connected to said shafts and said means E, imparting an exit speed to the material.

6. An apparatus as claimed in claim 5, further comprising a sensing means of the presence of the material in a predetermined position within the container.

7. An apparatus as claimed in claim 1, further comprising speed transmission means having an adjustable speed ratio.

8. An apparatus as claimed in claim 1, said container having longitudinal sidewalls at least partly concave and cojointly forming at its bottom a trough having an arcuate cross-section, the sides of the said trough enclosing a predtermined angle to provide contacts for the loops for their momentary interruptions in their advancement.

9. An apparatus as claimed in claim 8, the walls of the container each comprising a substantially cylindrical flank, the flanks intersecting each other along a common edge.

10. An apparatus as claimed in claim 8, particularly suitable for treatment of strip metal, the said predetermined angle equalling about 90°.

11. An apparatus as claimed in claim 8, particularly suitable for treatment of wire, the said predetermined angle equalling approximately 120°.

12. An apparatus as claimed in claim 8, said means G comprising a frictional lining on the walls of said container at the points of expected contacts of the loops therewith to cause said momentary interruptions.

13. An apparatus as claimed in claim 12, said lining being ceramic tile, said means G including a pair of parallel shafts mounted for cojoint rotation above said container spaced from each other.

14. An apparatus as claimed in claim 13 said shafts provided with lining such as of polyvinyl chloride, having a coefficient of friction substantially lower than that of the frictional lining of the walls of the container.

15. An apparatus for treatment of elongated flexible material in an elongated container filled with a treatment-fluid comprising:

a first normal operating stage of having means for:

imparting the material a coiled configuration of loops;

causing the loops to assume the shape of an elongated continuous helix;

imparting an entry speed to the material;

causing the helix to advance through the treatment-fluid at a predetermined level thereof;

regulating the linear advance speed of the material to equal about an average predetermined speed, the length of the material in the container thus increasing during said first stage;

imparting an egress speed to the material;

a second adjustment stage providing means to extract the material at the end of its advance through the container and means to decrease the ingress speed of the material.

16. An apparatus as claimed in claim 15, the said advance speed initially being about equal to the said egress speed.

17. An apparatus as claimed in claim 15, further comprising means to regulate the entry speed of the material into the container to exceed its exit speed by between about 0.2 and about 2 percent.

18. An apparatus as claimed in claim 15, further comprising means to control the ratio of the decreasing speed of the said second stage relative to the increasing speed of the said first stage to the order of a few hundred.

* * * * *